United States Patent [19]

Ward

[11] 4,403,800

[45] Sep. 13, 1983

[54] DOOR HANDLE ASSEMBLY

[76] Inventor: Desmond H. Ward, 3071 Woodside Dr., Jackson, Miss. 39212

[21] Appl. No.: 257,119

[22] Filed: Apr. 24, 1981

[51] Int. Cl.[3] ..... E05C 13/00

[52] U.S. Cl. ..... 292/350

[58] Field of Search ..... 292/350, 347; 403/320, 403/343; 411/393, 395

[56] References Cited

U.S. PATENT DOCUMENTS

| | | | |
|---|---|---|---|
| 695,319 | 3/1902 | Leslie . | |
| 2,947,561 | 8/1960 | Holden | 292/350 X |
| 3,239,233 | 3/1966 | Stillwagon, Jr. | 403/343 X |

*Primary Examiner*—Richard E. Moore

*Attorney, Agent, or Firm*—Cushman, Darby & Cushman

[57] ABSTRACT

An assembly for fixedly interconnecting a pair of door handles of the type requiring a specific normal predetermined orientation and for transmitting a turning movement in one direction applied to either of the door handles to a door latch mechanism to release the same comprising an elongated spindle including male threaded end portions for threadingly engaging within the female threaded cavities of the door handles, and male threaded members for threadingly and respectively engaging within the female threaded cavities of the door handles at a predetermined depth therein to specifically set the normal orientation of the door handles so that they are engageable during the turning movement of the spindle with respect to the door handles to effect rigid association by virtue of the threaded connections thereby insuring that the door handles will be normally maintained in a normal predetermined orientation.

12 Claims, 3 Drawing Figures

DOOR HANDLE ASSEMBLY

BACKGROUND AND SUMMARY OF THE INVENTION

The present invention generally relates to a door handle assembly which is preferably utilized to specifically set the orientation of a door handle of the type including a female threaded cavity and a male threaded spindle. Door handles which are of the type having a female threaded cavity and a male threaded spindle conventionally utilize a set screw or plurality of set screws in order to maintain the original orientation of the door handle.

Presently there exists a wide variety of door handles from which a consumer, contractor, architect or the like may choose. The shapes of conventional door handles may be broadly classified as either being round or of miscellaneous shapes. The most widely recognized door handle of the miscellaneous shape is the lever type door handle which requires a specific orientation in order to utilize its advantageous structural qualities. Although a door handle is round, there may be embossed thereon certain decorative designs, initials, words, or the like which require a specific orientation of the round door handle so that the decorative design or the like may be readily apparent when viewed in a normal upright position.

The present invention is related to the types and shapes of door handles which require a specific orientation. More specifically, the present invention relates to an assembly which maintains the original set orientation of the door handle throughout the useful life thereof.

As noted above, the lever type handle is required to be set in a specific orientation when mounted onto the spindle so that the beneficial structural effects may be realized. A lever type handle is preferably mounted upon the spindle so that the lever part of the handle is preferably parallel to the plane of the floor. In this manner, a great force may be transmitted directly to the spindle to operatively engage the latch in the door due to the inherent lever structure of the handle. Therefore, it is important that the original predetermined orientation of the door handle remains constant throughout the handle's useful life so that the beneficial effects of the lever type handle may be realized. A variance from the originally set orientation will render the lever type handle, or other door handles requiring a specific orientation, slovenly in appearance to such an extent that replacement may become necessary. Additionally, a variance from the original set position may promote deleterious effects which counter the inherent structural benefits of the lever handle.

One of the conventional methods of achieving specific orientation of a lever type handle has been to tap a female threaded hole generally perpendicular to the door handle cavity. When the female threaded cavity of the door handle is placed onto the spindle and a specified orientation is achieved, a conventional set screw is then placed into the female threaded hole until it bears upon the spindle. In such a manner, a localized force is developed between the conventional set screw and the spindle in such a manner that the operation of the handle will concurrently operate and transmit a rotational movement to the spindle vis-a-vis the conventional set screw, thereby operating the door latch.

However, a problem of utilizing the conventional set screw method of obtaining specific orientation of a door handle occurs when the localized area of the spindle in direct communication with the set screw becomes worn after repeated operation of the door handle to such an extent that the original orientation of the door handle cannot be maintained. When the spindle in the localized area of the conventional set screw becomes worn, slippage may occur thereby varying the predetermined orientation of the door handle as originally set. The conventional set screw must, therefore, be successively tightened as the area of the spindle in direct communication with it becomes worn in order to prevent the door handle from becoming disoriented. Additionally, the threads on the spindle will become worn to such an extent that they may be completely stripped necessitating replacement of the entire spindle. Such a result is unsatisfactory to the consumer who ultimately uses the door handle. Often, the same conventional set screw method of fixing a door handle to a spindle to achieve a specific orientation is utilized in a round door handle having decorative designs, initials, words, or the like embossed thereon with the same attendant problems.

According to the present invention however, the problems associated when utilizing a conventional set screw to achieve a specific orientation of a door handle are generally eliminated. More specifically, the present invention contemplates that the conventional set screw utilized to specifically orient a door handle will not be necessary, or in the alternative, be utilized only as an adjunct to the present invention to prevent the door handle from being removed from the spindle.

The assembly according to the present invention is particularly adaptable to specifically orient a door handle in such a manner that the problems of slippage and disorientation due to the localized wear when utilizing conventional set screws are eliminated.

The assembly according to the present invention utilizes a male threaded member which will threadingly cooperate with the female threaded cavity of the door handle. In this way, the spindle adjuster may be placed into the hub at a predetermined depth by conventional tools, such as, for example, a screwdriver. The door handle may subsequently be threaded upon the spindle until the end of the member comes into direct contact with the spindle. Thus, the specific predetermined depth at which the male threaded member is set determines the specific orientation of the door handle.

Therefore, according to the present invention there is provided an assembly which will effect a specific predetermined orientation of a door handle, preferably a lever type door handle, without the aid of conventional set screws. Additionally, the assembly according to the present invention is particulary advantageous when incorporated on a dual arrangement of door handles which are mounted upon spindles having opposite hand threads on each side of the door.

By utilizing opposite hand threads on each side of the door in such an arrangement, the door handle will necessarily be tightened and will remain in proper orientation during repeated operations of the door handle. The opposite hand threads of a spindle which may be satisfactorily utilized according to the pesent invention is of the type disclosed in U.S. Pat. No. 695,319, the disclosure of which is incorporated herein by reference. The quality of the threads contemplated by the present invention is not critical. Thus, very fine, very coarse or any quality therebetween may be satisfactorily utilized as long as the male threads on the threaded member generally correspond to the female threads of the door handle cavity.

Further benefits of utilizing the assembly of the present invention will become apparent to one of ordinary skill in the art from a reading of the detailed description of the invention below.

DETAILED DESCRIPTION OF THE INVENTION

Figure 1:
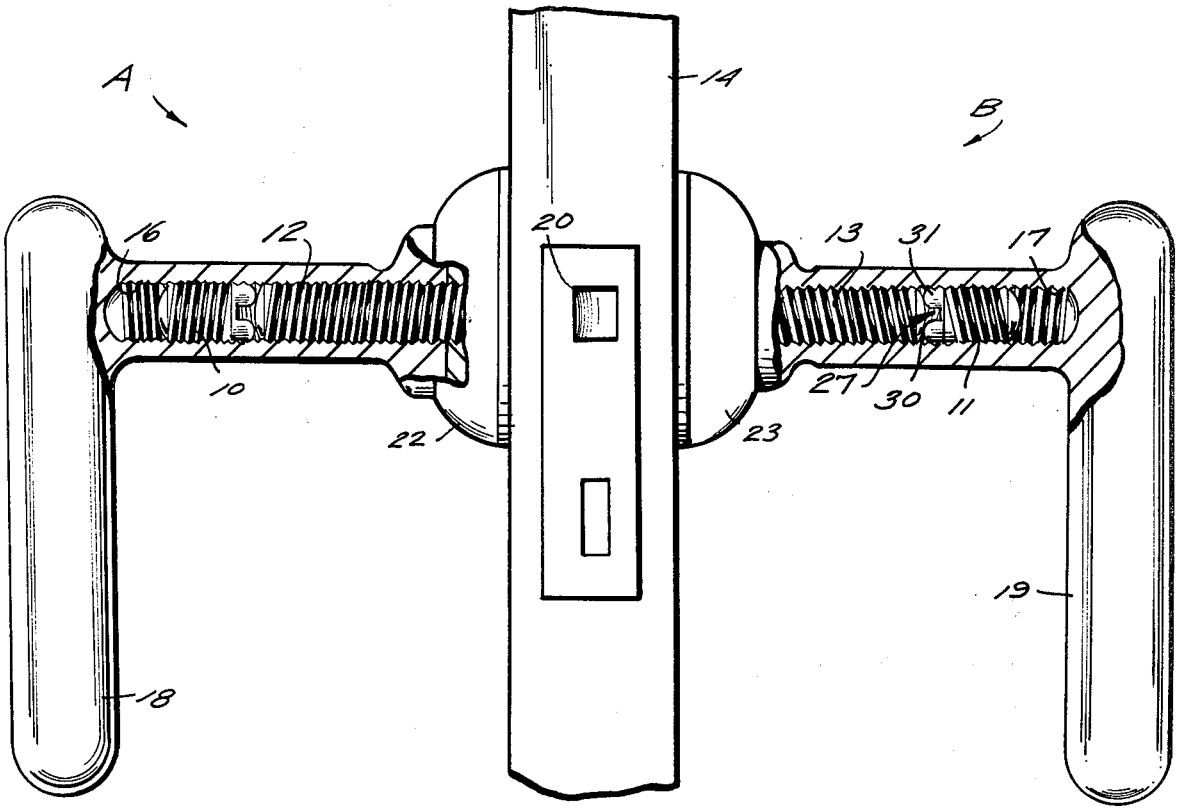
FIG. 1 is an elevational cross-sectional view of a dual door handle arrangement utilizing an assembly of the present invention.

Referring now more specifically to FIG. 1, wherein a preferred embodiment of the present invention is depicted and wherein male threaded members 10, 11 according to the present invention are shown in proper placement with a spindle having threaded end portions 12, 13 which extend beyond each side A and B, respectively, of the door 14. The spindle end portions 12, 13 are threadingly placed in the cavities 16, 17 of the lever type door handles 18, 19 to actuate a door latch mechanism 20.

The door handles 18, 19 shown in FIG. 1 are the dual lever type handles which may operate a door latch mechanism 20 from either side A or side B of the door 14. Although the dual arrangement of door handles 18, 19 is depicted, it will be understood by one of average skill in the art that the present invention may be utilized with a spindle extending from just one predetermined side of the door 14 and capable of one-way entry or exit therethrough for security or safety reasons.

Referring specifically to FIG. 1 and the door handle assembly associated therewith, it can be seen that the door handle 18 located on side A of the door is a lever type conventionally used to actuate a door latch mechanism 20. The lever tye door handle 18 has a female threaded cavity 16 into which the threaded member 10 and the spindle end portion 12 can be engaged. For decorative purposes, collars 22, 23 may preferably be provided between the door handles 18, 19 and the door 14.

The assembly as depicted in FIG. 1 and noted as side B, is similar in nature to the assembly on side A, discussed above, with the exception that it is the opposite hand thereof. More specifically, the female cavity 17 of the lever type handle 19, the threaded member 11 and the spindle end portion 13 all comprise opposite hand threads when compared to side A. For example, the assembly of side A may comprise left-hand threads while side B would have right-hand threads. The opposite threading of the spindle end portions 12, 13 and associated member will necessarily cause the handles 18, 19 to be continuously tightened against the threaded members 10, 11 when the door handles 18, 19 are operated. In such a manner, the lever type handles 18, 19 would not be loosened due to operational action thereof.

Figure 2:
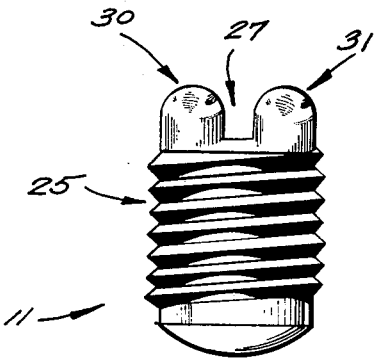
FIG. 2 is an elevational view of a representative male threaded member according to the present invention.
Figure 3:
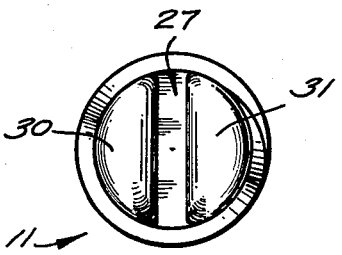
FIG. 3 is a top view of the representative member shown in FIG. 2.

Referring now more specifically to FIGS. 2 and 3 wherein a representative male threaded member 11 corresponding to side B is shown, it can be seen that the threaded member adjuster 11 generally comprises a male threads for being threaded into the female threaded cavity 17 of the door handle 19. Additionally, the threaded member 11 includes a slot 27, depression or the like into which a hand tool, such as, for example, a screw driver, may be mated.

The slot 27, depression or the like enables a person installing the door handle 19 to engage the threaded member 11 at a predetermined depth in the female threaded cavity 17 of the door handle. Additionally, the upper portion of the opposite side surfaces defining the slot 27 may be rounded to a predetermined extent. The threaded member adjuster 11 set at the predetermined depth will necessarily determine the orientation of the lever type handle 19 vis-a-vis the spindle end portion 13 when the handle 19 is placed thereon. The lever type handle 19 may subsequently be threaded onto the spindle end portion 13 until the spindle end portion 13 the threaded member 11 previously placed into the cavity 17 of the lever type handle 19 come into direct contact.

The surfaces 30, 31 of the threaded member 11 which are in direct contact with the spindle end portion 13 are an important part of the present invention. In the embodiment depicted in FIG. 1, it can be seen that the surfaces 30, 31 in contact with the spindle end portion 13 are rounded to an extent that only a minimal or predetermined portion of the surfaces 30, 31 are in direct contact with the spindle end portion 13. In this manner, the threaded member 11 is generally in point contact with the terminal end of the spindle end portion 13 and generally transmits only a linear force and not a torque or rotational force thereto. Thus, when the door handle is rotated, the threaded member 11 remains set at its predetermined depth while transmitting a linear force to the spindle end portion 13. The linear force causes the entire area of thread on the threaded member 11 to accept and transmit the force to the spindle end portion 13. Thus, a rigid threaded union is forceably formed during operation of the lever type door handle 19 thereby causing the spindle to rotate concurrently therewith.

One of the primary beneficial effects resulting from the threaded member 11 is that the orientation of the lever type handle 19 will not be changed since the depth of the threaded member 11 in the cavity 17 of the lever handle 19 will remain constant. Thus, it can be seen by one of ordinary skill in the art that various orientations of the lever type handle 19 may result depending upon the depth that the threaded member 11 is placed into the cavity 17 of the door handle 19. Preferably, the lever handle 19 is oriented to sthat it is generally parallel to the plane of the floor. Also, with the threaded member 11 properly in place, the handle 19 and the spindle are caused to concurrently rotate such that the force applied to the handle 19 is directly transferred to the spindle without the concurrent movement or variance of the depth of the threaded member adjuster 11 in the cavity 17 of the handle 19.

The assembly depicted in FIG. 1, as noted above, shows a dual door handle assembly. In such an embodiment, it is preferred that the elements of one side of the door, for example, side A, comprise left-hand threaded components, while the elements of the opposite side, for example, side B, comprise right-hand threaded components. The threaded member 11 may be manufactured to include either left-hand threads or right-hand threads so that they may be readily adapted to such a dual type arrangement wherein the spindle comprises portions on one side of left-hand threads and the opposite side of right-hand threads.

While reference has been herein made to a dual door handle arrangement, with opposite-hand threads associated therewith, it will be apparent that any variation of thread arrangements or door handle arrangements may advantageously utilize the spindle adjuster of the present invention. Additionally, while reference has been specifically made to the operation of assembly on side B of the door, it should be understood that the operation of side A is identical except opposite hand thereof.

The spindle adjuster may advantageously be utilized with most conventional door latch and spindle mechanisms. Preferably, the door latch is of a type which has a normally latched position and which may be moved reciprocally to an unlatched position in response to a turning movement of the spindle. A central portion of the spindle in such conventional door latch mechanisms generally are in mechanical communication with the door latch so that a turning movement of the spindle will translate into a reciprocal action of the door latch thereby moving it from the normally latched position to the normally unlatched position.

Additionally, while reference has been herein made to the lever type handle, it will be understood that the assembly according to the present invention may be utilized with any door handle which requires a specific orientation of the type utilizing a threaded cavity and spindle. For example, a round door knob having a decorative design could advantageously utilize the spindle adjuster of the present invention to effect a predetermined orientation.

While the invention has been herein described in what is presented conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent assemblies and structures.

What I claim is:

1. An assembly for fixedly interconnecting a pair of door handles of the type requiring a specific normal predetermined orientation and for transmitting a turning movement in one direction applied to either of said door handles to a door latch mechanism to release the same, said assembly comprising:

an elongated spindle including a first male threaded end portion threadingly engaged within a first female threaded cavity of a first door handle, and a second male threaded end portion threadingly engaged within a second female threaded cavity within a second door handle, and a central portion engaged with the door latch mechanism in motion transmitting relationship therewith;

a first male threaded member threadingly engaged within said first female threaded cavity of said first door handle;

first means on one end of said first member defining surfaces for mating with a turning tool so that said first member can be threadingly engaged within said first female threaded cavity at a predetermined depth therein corresponding to the normal predetermined orientation of said first door handle with respect to said spindle;

first interengaging surface means on the terminal end of said first end portion of said spindle and on said one end of said first member engageable during the turning movement of said spindle with respect to said first door handle so that said first interengaging surface means are wedgingly engaged in rigid association by virtue of the threaded connections of said first spindle end portion and said first member with said first door handle therewith for preventing the transmission of turning movement of said spindle to said first member thereby insuring that said first handle will be normally maintained in said normal predetermined orientation;

a second male threaded member threadingly engaged within said second female threaded cavity of said second door handle, second means on one end of said second member defining surfaces for mating with a turning tool so that said second member can be threadingly engaged within said second female threaded cavity at a predetermined depth therein corresponding to the normal predetermined orientation of said second door handle with respect to said spindle; and second interengaging surface means on the terminal end of said second end portion of said spindle and on said one end of said second member engageable during the turning movement of said spindle with respect to said second door handle so that said second interengaging surface means are wedgingly engaged in rigid association by virtue of the threaded connections of said second spindle end portion and said second member with said second door handle therewith for preventing the transmission of turning movement of said spindle to said second member thereby insuring that said second handle will be normally maintained in said normal predetermined orientation.

2. An assembly as in claim 1 wherein said first male threaded end portion of said spindle and said first male threaded member are right-hand threaded for threadingly cooperating with said first female cavity, and said second male threaded end portion of said spindle and said second male threaded member are left-hand threaded for threadingly cooperating with said second female cavity so that normal operational turning movements applied to said first or second door handles are in a direction tending to tighten the engagement of said first or second interengaging surface means, respectively.

3. An assembly as in claims 1 or 2 wherein said first and second interengaging surface means comprise generally rounded surfaces.

4. An assembly as in claim 3 wherein said turning tool mating surface means generally defines parallel opposite side surfaces and a bottom surface, said opposite side surfaces being generally perpendicular to said bottom surface and generally rounded on the upper portion thereof.

5. A door handle assembly comprising:

a latch mechanism mounted for reciprocal movement between a normally latched position and an unlatched position;

an elongated male threaded spindle operatively connected to said latch mechanism so that a turning movement of said spindle will translate into said reciprocal movement of said latch mechanism from said normally latched position to said unlatched position, and including at least one male threaded end portion having a terminal end;

at least one door handle requiring a specific orientation thereof and defining an elongated female threaded cavity threadingly engaged upon said spindle for operatively turning said spindle in response to a force applied to said door handle;

a first male threaded member threadingly engaged within said cavity;

means on one end of said first member defining surfaces for mating with a turning tool so that said first member can be threadingly engaged within said female threaded cavity at a predetermined depth therein corresponding to the normal predetermined orientation of said door handle with respect to said spindle, and interengaging surface means on said terminal end of said male threaded end portion of said spindle and on said one end of said member engageable during the turning movement of said spindle with respect to said door handle so that said interengaging surface means are wedgingly engaged in rigid associated by virtue of the threaded connections of said spindle end portion and said member with said door handle therewith for preventing the transmission of turning movement of said spindle to said member thereby insuring that said door handle will be normally maintained in said normal predetermined orientation.

6. An assembly as in claim 5 wherein said spindle includes a first male threaded end portion and a second male threaded end portion having first and second terminal ends respectively and a central portion for operatively being connected to said latch mechanism.

7. An assembly as in claim 6 wherein two said door handles are provided such that the first mentioned door handle defines a first mentioned elongated female threaded cavity threadingly engaged upon said first spindle end portion and the second door handle defines a second elongated female threaded cavity threadingly engaged upon said second spindle end portion.

8. An assembly as in claim 7 wherein said first mentioned male threaded member is threadingly engaged within said first mentioned female threaded cavity of said first mentioned door handle and wherein said assembly further comprises:

a second male threaded member threadingly engaged within said second female threaded cavity of said second door handle;

second means on one end of said second member defining surfaces for mating with a turning tool so that said second member can be threadingly engaged within said second female threaded cavity at a predetermined depth therein corresponding to the normal predetermined orientation of said second door handle with respect to said spindle; and second interengaging surface means on said second terminal end of said second male threaded end portion of said spindle and on said one end of said second member engageable during the turning movement of said spindle with respect to said door handle so that said second interengaging surface means are wedgingly engaged in rigid association by virtue of the threaded connections of said second spindle end portion and said second member with said second door handle therewith for preventing the transmission of turning movement of said spindle to said second member thereby insuring that said second door handle will be normally maintained in said normal predetermined orientation.

9. An assembly as in claim 8 wherein said first male threaded end portion of said spindle and said first mentioned male threaded member are right-hand threaded for threadingly cooperating with said first mentioned female cavity, and said second male threaded end portion of said spindle and said second male threaded member are left-hand threaded for threadingly cooperating with said second female cavity so that normal oprational turning movements applied to said first or second door handles are in a direction tending to tighten the engagement of said first mentioned or said second interengaging surface means, respectively.

10. An assembly as in claims 8 or 9 wherein said first mentioned and said second interengaging surface means comprise generally rounded surfaces.

11. An assembly as in claim 10 wherein said first mentioned and said second turning tool mating surface means generally define parallel opposite side surfaces and a bottom surface, said opposite side surfaces being generally perpendicular to said bottom surface and generally rounded on the upper portion thereof.

12. An assembly as in claim 10 wherein said first mentioned and said second door handles are lever type door handles.

* * * * *